US006942311B2

(12) United States Patent
Eto

(10) Patent No.: US 6,942,311 B2
(45) Date of Patent: Sep. 13, 2005

(54) INK-JET RECORDING APPARATUS

(75) Inventor: Yoshiro Eto, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/410,399

(22) Filed: Apr. 10, 2003

(65) Prior Publication Data

US 2004/0100515 A1 May 27, 2004

(30) Foreign Application Priority Data

Nov. 26, 2002 (JP) ..... 2002-342667

(51) Int. Cl.[7] ..... B41J 29/393; B41J 2/385
(52) U.S. Cl. ..... 347/19; 347/116
(58) Field of Search ..... 347/19, 116, 12, 347/13, 42, 43

(56) References Cited

U.S. PATENT DOCUMENTS 5,040,003 A * 8/1991 Willis ..... 347/118
5,198,054 A * 3/1993 Drake et al. ..... 156/64
5,992,973 A * 11/1999 Wen ..... 347/43
6,350,004 B1 2/2002 Askren ..... 347/14
6,412,903 B1 * 7/2002 Lee et al. ..... 347/19
6,431,683 B1 8/2002 Ho et al. ..... 347/50
6,474,765 B2 * 11/2002 Beauchamp ..... 347/14

FOREIGN PATENT DOCUMENTS

| | | |
|---|---|---|
| EP | 0 674 993 | 10/1995 |
| EP | 0 677 387 | 10/1995 |
| EP | 1 029 673 | 8/2000 |
| EP | 1 043 159 | 10/2000 |
| JP | 2000-964 | 1/2000 |

* cited by examiner

*Primary Examiner*—Thinh Nguyen
(74) *Attorney, Agent, or Firm*—Oblon, Spivak, McClelland, Maier & Neustadt, P.C.

(57) ABSTRACT

An ink-jet recording apparatus has ink-jet heads provided for respective colors including a specific color, each being formed by arranging a plurality of head units in a transversal direction perpendicular to the printing direction and a printing timing regulating section which regulates the printing timings of the respective head units so as to make the printing position of the nozzle located at an end of each of the head units of the ink-jet head of the specific color and the printing position of the nozzle located at the opposite end of the adjacent head unit are paired and made agree with each other in the printing direction.

12 Claims, 6 Drawing Sheets

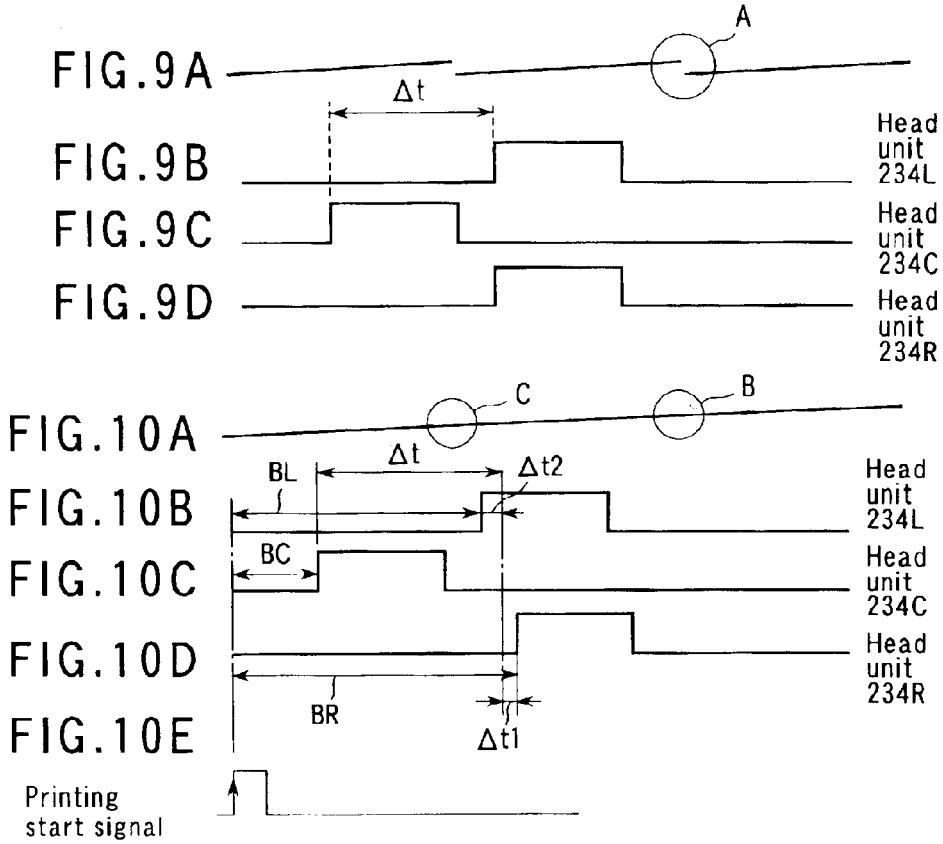
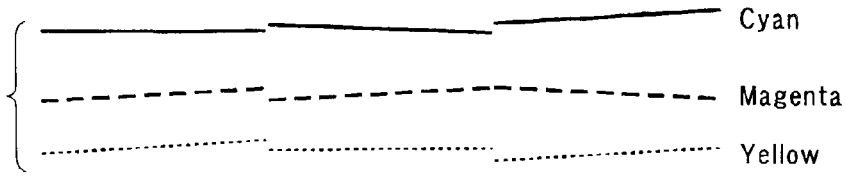
FIG.11
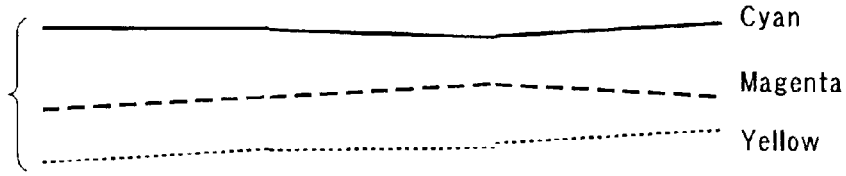
FIG.12

INK-JET RECORDING APPARATUS

CROSS-REFERENCE TO THE RELATED APPLICATIONS

This application is based upon and claims the benefit of priority from the prior Japanese Patent Application No. 2002-342667, filed Nov. 26, 2002, the entire contents of which are incorporated herein by reference.

BACKGROUND OF THE INVENTION

1. Field of the Invention

The present invention relates to an ink-jet recording apparatus comprising ink-jet heads, each being formed by arranging a plurality of head units, each having a number of ink discharge ports arranged in a row.

2. Description of the Related Art

Ink-jet recording apparatus comprising a plurality of ink-jet heads, each being formed by arranging a plurality of head units, each having a number of ink discharge ports arranged in a row, are known.

Since each ink-jet head is formed by arranging a plurality of head units, the head units can show different inclinations.

Therefore, there have been developed mechanisms for correcting the inclination of each head unit. Some known ink-jet recording apparatus have hardware and/or software installed therein in order to control the printing position of each nozzle of each ink-jet head in a sophisticated way.

However, such known techniques can take time for the regulating operation and involve high cost.

BRIEF SUMMARY OF THE INVENTION

An object of the present invention is to provide an ink-jet recording apparatus comprising an ink-jet head formed by arranging a plurality of head units, each having a number of ink discharge ports arranged in a row, in which the printing positions can be registered with ease by regulating the timings of printing of the head units.

According to an aspect of the present invention, the above object is achieved by providing an ink-jet recording apparatus comprising: ink-jet heads provided for respective colors including a specific color, each being formed by arranging a plurality of head units in a transversal direction perpendicular to the printing direction; and a printing timing regulation means for regulating the printing timings of the respective head units so as to make the printing position of the nozzle located at an end of each of the head units of the ink-jet head of the specific color and the printing position of the nozzle located at the opposite end of the adjacent head unit are paired and made agree with each other.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 9A through 9D show a printed image and driving timings when the ink-jet recording heads of the embodiment is operated with a predetermined time lag;

FIGS. 10A through 10E show a printed image and driving timings when the ink-jet recording heads of the embodiment is operated so as to register the opposite ends of the line segments produced by the respective head units;

FIG. 11 shows the line segments printed by the ink-jet recording heads for ink colors, such as cyan, of the embodiment at predetermined timings necessary for registration;

FIG. 12 shows the line segments printed by the ink-jet recording heads for ink colors of the embodiment by regulating the printing timings so as to minimize misregistration;

DETAILED DESCRIPTION OF THE INVENTION

Figure 1:
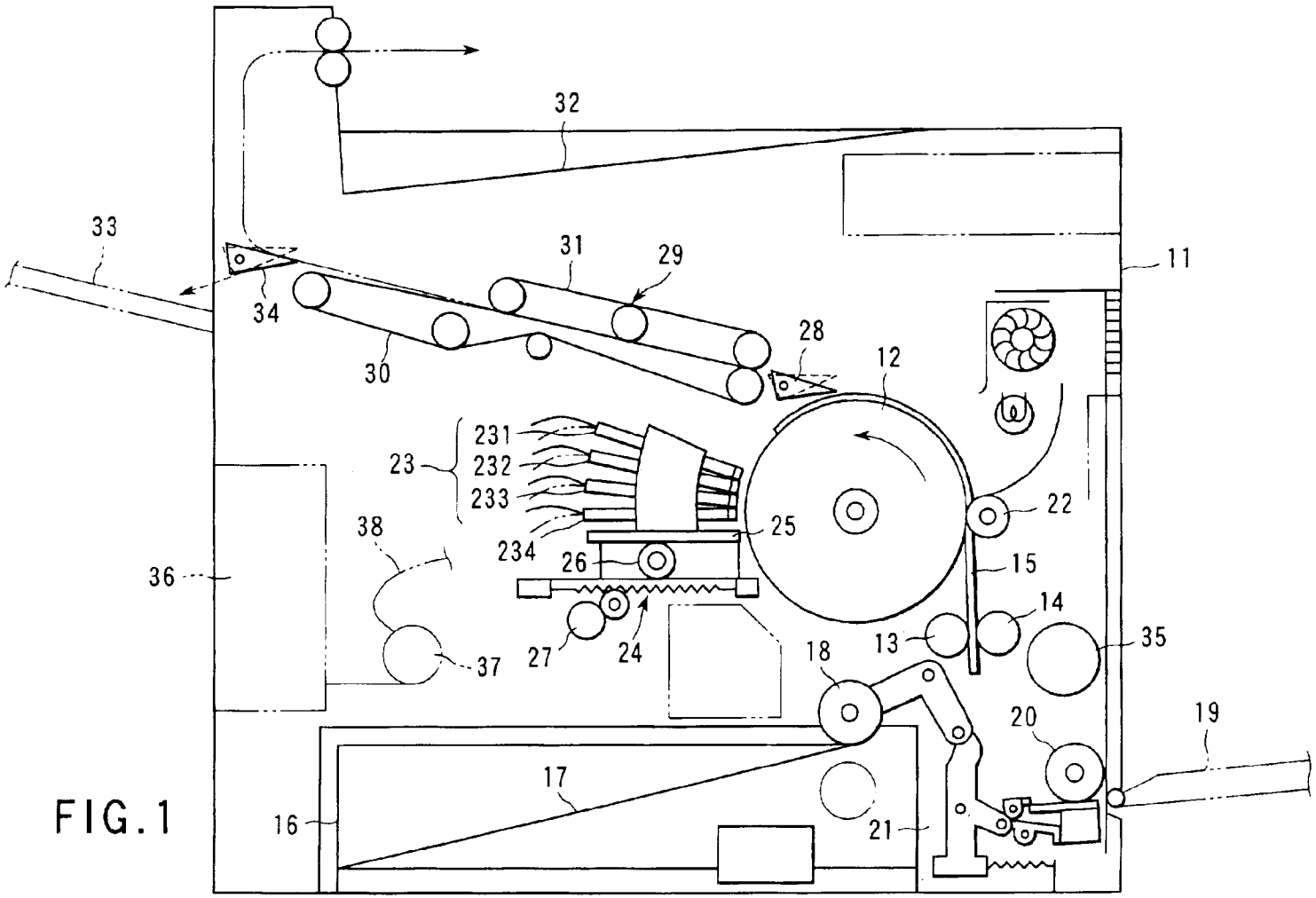
FIG. 1 is a schematic view showing the configuration of the mechanism section of an embodiment of an ink-jet recording apparatus according to the invention.

FIG. 1 is a schematic view showing the configuration of the mechanism section of the first embodiment of an ink-jet recording apparatus. In FIG. 1, reference symbol 11 denotes a main body case. A drum 12 is arranged in the main body case 11 and adapted to rotate at a constant peripheral speed in the direction indicated by an arrow in FIG. 1. A recording medium 15, which may be a sheet of recording paper fed by way of a pair of paper feeding rollers 13, 14 is wound around the drum 12.

A sheet feeding cassette 16 is arranged at the bottom of the main body case 11. A recording medium 15 arranged on table plate 17 of the sheet feeding cassette 16 are taken out one by one by a feed roller 18 and fed to the paper feeding rollers 13, 14. The recording medium 15 manually fed from a manual feed tray 19 arranged at a lateral side of the main body case 11 so as to be freely opened and closed may also be conveyed to the paper feeding rollers 13, 14 by way of a feed roller 20. The feed roller 18 and the feed roller 20 are selectively used for feeding a recording medium by means of a feed switching means 21.

A charging roller 22 is arranged opposite to the drum 12 in order to cause the recording medium 15 fed from the paper feeding rollers 13, 14 to be adsorbed by the drum surface. Additionally, four ink-jet recording heads 231, 232, 233, 234, each comprising a large number of linearly disposed recording elements are also arranged opposite to the drum 12. The four ink-jet recording heads 231, 232, 233, 234 may also be referred to collectively as ink-jet recording head 23 hereinafter. The ink-jet recording heads 231, 232, 233, 234 are incorporated in the printing mechanism 24 so as to be movable in the direction of the rotary shaft of the drum 12 in which the recording elements are disposed.

Thus, the recording medium 15 is conveyed by the revolving drum 12 in a direction (the printing direction) substantially perpendicular to the direction (transversal to the printing direction) in which the recording elements of the ink-jet recording heads 231 through 234 are disposed.

The recording head 231 discharges cyan (C) ink and the recording head 232 discharges magenta (M) ink, while the recording head 233 discharges yellow (Y) ink and the recording head 234 discharges black (B) ink. The recording head 231, the recording head 232, the recording head 233 and the recording head 234 are arranged in parallel with each other in the mentioned order from the upstream side of the conveyance route of the recording medium 15 that is wound around the drum 12 and conveyed. They are separated from each other with predetermined gaps.

Each of the ink-jet recording heads 231 through 234 is provided with a large number of ink discharge ports 23*a* that are arranged at a predetermined pitch and adapted to operate as so many recording elements.

Figure 19:
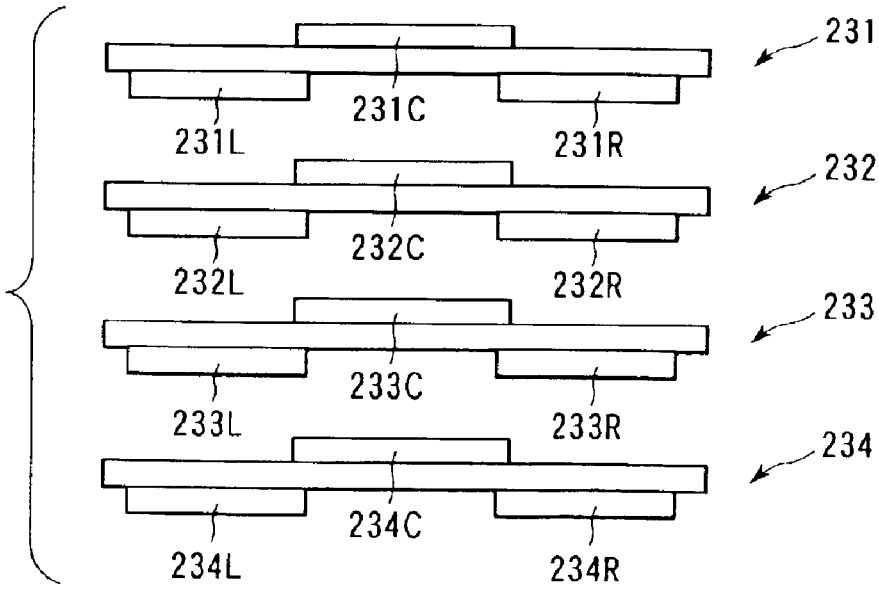
FIG. 19 is a schematic illustration showing the positional arrangement of the head units of the ink-jet recording heads 231 to 234 of the embodiment.

As shown in FIG. 19, the ink-jet recording heads 231 through 234 are formed by arranging head units 231L, 231C, 231R, 232L, . . . , 234R.

Referring to FIG. 19, the head unit 231L of the ink-jet recording head 231, the head unit 232L of the ink-jet recording head 232, the head unit 233L of the ink-jet recording head 233 and the head unit 234L of the ink-jet recording head 234 commonly covers the same printing range. A similar statement applies to other head units.

Since the ink-jet recording heads 231 through 234 have the same configuration, only the ink-jet recording head 234 will be described with reference to FIGS. 4 and 5.

Figure 4:
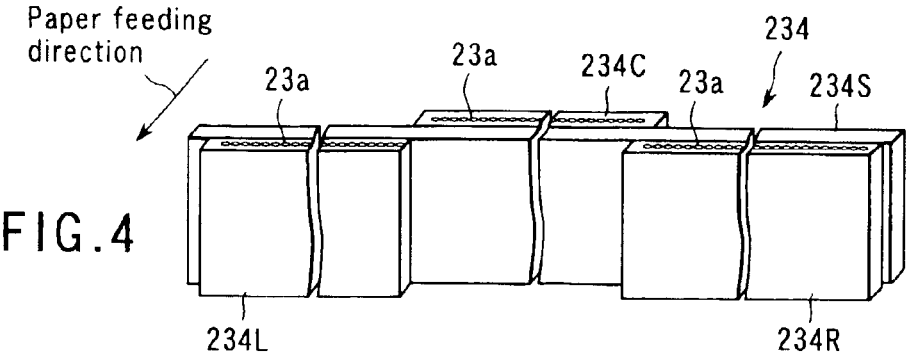
FIG. 4 is a schematic perspective view showing one of the ink-jet recording heads of the embodiment.
Figure 5:
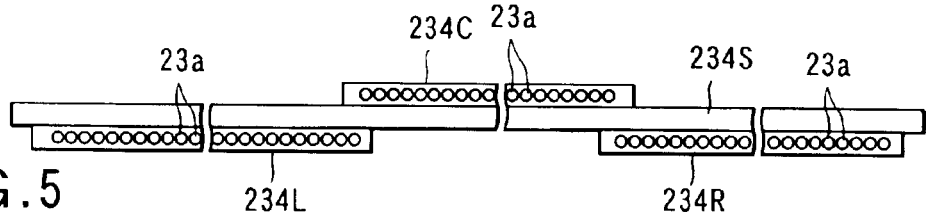
FIG. 5 is a schematic illustration showing the positional relationship of the ink discharge ports of each head unit of one of the ink-jet recording heads of the embodiment.
Figure 6:
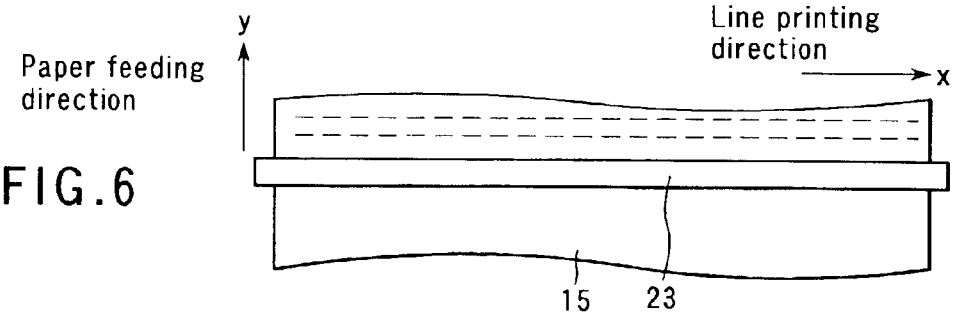
FIG. 6 is a schematic illustration showing the relationship between the ink-jet recording head and the direction of conveyance of the recording medium of the embodiment.

As shown in FIGS. 4 and 5, the ink-jet recording head 234 has three head units 234L, 234C and 234R, each of which is provided with a large number of ink discharge ports 23*a* that are arranged at a predetermined pitch and adapted to operate as so many recording elements. The three head units 234L, 234C and 234R are bonded to a common substrate 234S on the opposite sides thereof. More specifically, the head unit 234C is bonded to a middle position of the common substrate 234S on one of the opposite sides thereof, whereas the head units 234L and 234R are bonded at respective end positions of the common substrate 234S on the other side thereof to form a single ink-jet recording head. Thus, in this recording apparatus, all the head units of an ink-jet recording head of a single color are bonded to a common substrate and hence their inclinations cannot be corrected individually.

The head unit 234C, the head unit 234L and the head unit 234R are arranged in such a way that all the ink discharge ports thereof are arranged at regular intervals in the recording line.

More specifically, the head unit 234L and the head unit 234C are arranged in such a way that the ink discharge port of the former located at the end close to the latter and the ink discharge port of the latter located at the end close to the former are separated from each other by a distance equal to the pitch of arrangement of the other ink discharge ports. Similarly, the head unit 234C and the head unit 234R are arranged in such a way that the ink discharge port of the former located at the end close to the latter and the ink discharge port of the latter located at the end close to the former are separated from each other by a distance equal to the pitch of arrangement of the other ink discharge ports.

While the ink discharge ports 23*a* of the head units 234L and 234R and the ink discharge ports 23*a* of the head unit 234C are not aligned in the longitudinal direction of the common substrate, the three head units 234L, 234C, 234R are so devised that they provide a printing effect same as the one that is obtained when all the ink discharge ports 23*a* of the head units 234L, 234C, 234R are perfectly aligned by regulating the timings of discharging ink of the head units 234L, 234C, 234R.

The printing mechanism 24 comprises a reciprocating mechanism 25 carrying the ink-jet recording heads 231 through 234, a motor unit 26 including a reciprocating rod and a linear motor and an advancing/retreating means 27. The ink-jet recording heads 231 through 234 are driven to advance forward or retreat from the peripheral surface of the drum 12 by the advancing/retreating means 27. The reciprocating mechanism 25 is moved under control in the direction of the rotary shaft of the drum 12 by the motor unit 26 in order to reciprocate the ink-jet recording heads 231 through 234 in the direction of the rotary shaft, or the line direction of the recording medium 15.

The drum 12 is provided with a peeling claw 28 that can be inserted between the peripheral surface of the drum 12 and the recording medium 15. The recording medium 15 peeled off by the peeling claw 28 is delivered to a recording medium discharge/delivery mechanism 29. The recording medium discharge/delivery mechanism 29 comprises a belt conveyor 30 held in contact with the non-recording surface of the recording medium 15 and a push/press means 31 for pushing/pressing the recording medium 15 against the corresponding surface of the belt conveyer 30.

A direction switcher 34 is arranged at the downstream end of the belt conveyor 30 and adapted to selectively deliver the recording medium 15 conveyed by the belt conveyor 30 either onto an upper delivery tray 32 arranged in an upper part of the main body case 11 or onto a delivery tray 33 removably fitted to a lateral side of the main body case 11.

The main body case 11 contains in the inside thereof a main motor 35 for driving various parts to rotate, an ink cassette 36 for supplying inks, an ink buffer 37 for temporarily storing the inks supplied from the ink cassette 36 and an ink supply tube 38 for supplying inks from the ink buffer 37 to the respective ink-jet recording heads 231 through 234.

With the embodiment of color ink-jet recording apparatus having the above described configuration, a recording medium 15 is typically taken out from the sheet feeding cassette 16 by means of the feed roller 18 and sent to the paper feeding rollers 13, 14 for a recording operation. The paper feeding rollers 13, 14 feed the recording medium 15 to the revolving drum 12 and wind it around the revolving drum 12. Then, the recording medium 15 is adsorbed by and wound around the surface of the drum 12 by the charging roller 22.

As the drum 12 revolves, the recording medium 15 is driven to move in the direction of arrangement of the ink-jet recording heads 231 through 234. Then, inks of different colors are selectively discharged from the ink discharge ports of the ink-jet recording heads 231 through 234 at predetermined timings according to the image signal for color image recording.

Figure 2:
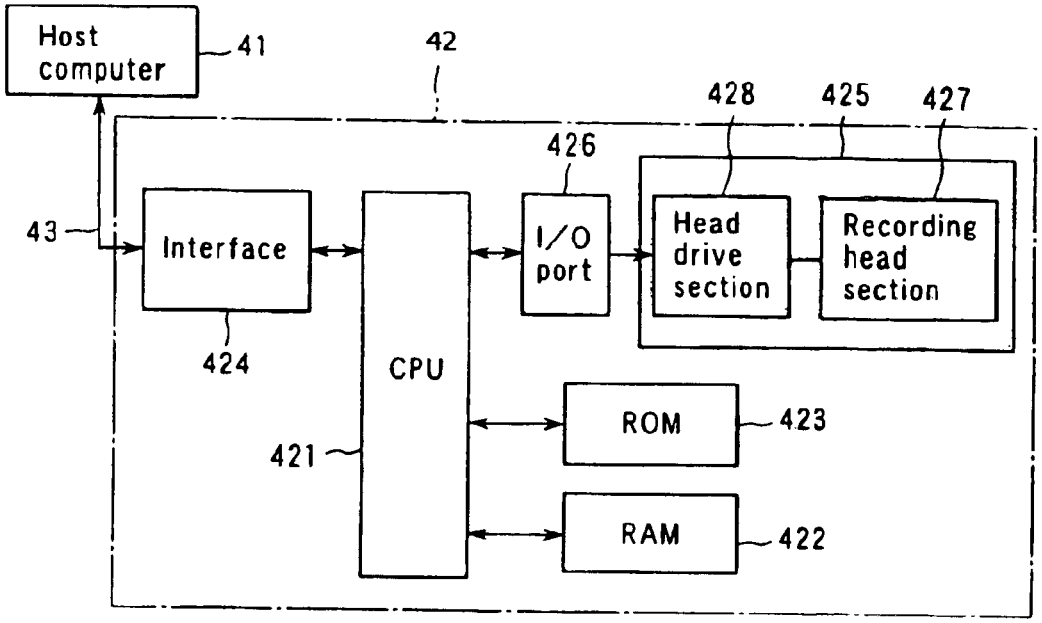
FIG. 2 is a block diagram showing the entire configuration of the control system of the embodiment.

FIG. 2 is a block diagram showing the entire configuration of the control system. Referring to FIG. 2, host computer 41 and the color ink-jet recording apparatus 42 are connected by a cable 43 so that color image signals are transmitted from the host computer 41 to the color ink-jet recording apparatus 42.

The color ink-jet recording apparatus 42 comprises a CPU (central processing unit) 421 that is the main body of the control section of the apparatus. A RAM (random access memory) 422 that includes a work memory to be used by the CPU 421 for processing operations and a temporary storage memory for temporarily storing an image signal. A ROM (read-only memory) 423 for storing program data to be used by the CPU 421 for controlling various components. An interface 424 to be used for transmitting data to and receiving data from the host computer 41. An I/O port 426 connected to the printing mechanism section 425.

The printing mechanism section 425 includes a recording head section 427 having the ink-jet recording heads 231 through 234 and a head drive section 428 for driving the ink-jet recording heads 231 through 234 of the recording head section 427. It may be needless to say that the printing mechanism section 425 also includes the above described printing mechanism 24.

The CPU 421 controls the printing mechanism section 425 for printing operations. More specifically, as the CPU 421 takes in a color image signal from the host computer 41, it temporarily stores the image signal in the RAM 422 and then performs an image processing operation on the signal, which is subsequently supplied to the printing mechanism section 425 to cause the section 425 to operate for color image recording.

The head drive section 428 has timers as many as the head units of the ink-jet recording heads 231 through 234. Since each of the four ink-jet recording heads of this embodiment has three head units, the head drive section 428 has a total of 4×3=12 timers.

Figure 3:
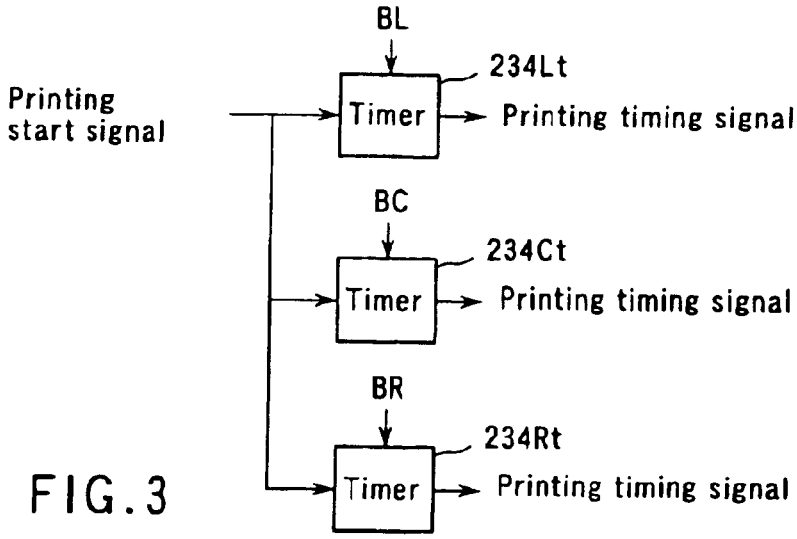
FIG. 3 is schematic illustration showing the printing timing regulating section of the embodiment.

FIG. 3 shows the three timers for the black (B) ink-jet recording head 234. Referring to FIG. 3, reference symbol 234Lt denotes the timer adapted to output printing timing signals to the head unit 234L and reference symbol 234Ct denotes the timer adapted to output printing timing signals to the head unit 234C, whereas reference symbol 234Rt denotes the timer adapted to output printing timing signals to the head unit 234R in the ink-jet recording head 234.

The timers 234Lt, 234Ct and 234Rt output respective printing timing signals after the elapses of predetermined times of BL, BC and BR after a printing start signal is input. The head units 234L, 234C and 234R discharge ink in response to the respective printing timing signals.

Similarly, the remaining ink-jet recording heads 231 through 233 have three timers 231Lt, 231Ct, 231Rt, 232Lt, 232Ct, 232Rt and 233Lt, 233Ct, 233Rt. These timers operate exactly same as those of the ink-jet recording head 234.

Now, the registering operation will be described below.

(1) Firstly, printed line segments of black ink are registered because they are used frequently particularly for rule marks. The visual sense of the human body is characterized in that it notices an abruptly broken line more easily than a mildly inclined line. A most eye catching color or a color that is used most frequently may be selected in place of black as specific color to be used for the purpose of the present invention.

Now, assume that in the ink-jet recording head 234, the right end of the left head unit 234L is raised and the right end of the center head unit 234C is also raised, whereas the right end of the right head unit 234R is lowered.

Figure 8:
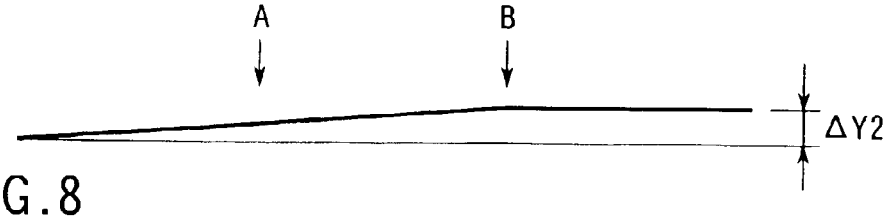
FIG. 8 is a schematic illustration showing printing of the embodiment when the printing timings are so regulated as to register the opposite ends of two adjacent line segments produced by one of the ink-jet recording heads.

FIG. 8 shows a situation where the printing timings are so regulated that the rule mark printed by the head units 234L, 234C and 234R does not show any misregistration at the junctions. In FIG. 8, the downward arrows A and B indicate the respective junctions of the line segments. While the discrepancy [ΔY2] between the Y-coordinate value of the left end and that of the right end of the rule mark is relatively large, the rule mark appears as straight line to the human eye.

Figure 7:
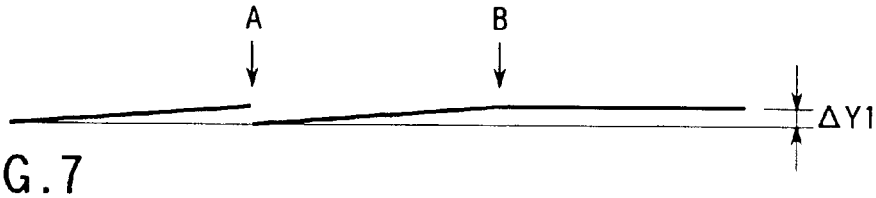
FIG. 7 is a schematic illustration showing printing of the embodiment when the printing timings are so regulated as to minimize the discrepancy of Y-coordinate values of the opposite ends of two adjacent line segments produced by one of the ink-jet recording heads.

On the other hand, FIG. 7 shows a situation where the printing timings are so regulated that the discrepancy [ΔY1] between the Y-coordinate value of the left end and that of the right end of the rule mark is minimized. In FIG. 7, the downward arrows A and B indicate the respective junctions. In this case, the line segments printed by the left head unit 234L and the center head unit 234C are not junctioned properly.

Thus, the technique of making the Y-coordinate values of the line segments printed by the black head units agree with each other to minimize the discrepancy of the Y-coordinate values has a drawback of producing junction errors that are easily noticeable to the visual sense.

Thus, with this embodiment, the timings of starting printing of the right and left head units 234R, 234L that are located adjacent to the center head unit 234C arranged on the upper stream side of the conveyance of the recording medium 15 are electrically so regulated that the right end of the line segment printed by the center head unit 234C and the left end of the line segment printed by the right head unit 234R agree with each other, while the left end of the line segment printed by the center head unit 234C and the right end of the line segment printed by the left head unit 234L agree with each other.

FIG. 9A shows line segments produced when the black ink-jet recording head 234 having the configuration of FIGS. 4 and 5 is operated with a predetermined time lag of Δt. FIGS. 9B through 9D show the timings of driving the ink-jet recording heads. Ink is discharged to print on the recording medium 15 during the time period of High.

Referring to FIG. 9A, the right end of the line segment printed by the center head unit 234C is located above the left end of the line segment printed by the right head unit 234R (see area A in FIG. 9A) indicating that the center head unit 234C is driven to operate earlier than the right head unit 234R by a predetermined time period of Δt. In other words, when the center head unit 234C is driven to operate earlier than the right head unit 234R by the time period Δt, the step formed at the junction between the right end of the line segment printed by the center head unit 234C and the left end of the line segment printed by the right head unit 234R are noticeable. The major factors that are responsible to this problem include the amount of adhesive used to secure each of the head unit 234L, 234C, 234R to the substrate 234S and the thickness of the right end and that of the left end of each of the head units.

In such a situation, the right end of the line segment printed by the center head unit 234C and the left end of line segment printed by the right head unit 234R are regulated so as to show the same Y-coordinate value and hence become junctioned properly by delaying the printing timing of the right head unit 234R relative to the printing timing of the center head unit 234C by a time period of Δt1 so that the step formed at the junction is not noticeable at all (see area B in FIG. 10A).

The left end of the line segment printed by the center head unit 234C and the right end of the line segment printed by the left head unit 234L are regulated in a similar manner. More specifically, the printing timing of the left head unit 234L is made earlier relative to the printing timing of the center head unit 234C by a time period of Δt2 as shown in FIG. 10B. Then, the left end of the line segment printed by the center head unit 234C and the right end of line segment printed by the left head unit 234L show the same Y-coordinate value and hence become junctioned properly so that the junction is not noticeable at all (see area C in FIG. 10A). It is noticed that Δt1 is the regulating value of the head unit 234R for the head unit 234C and Δt2 is the regulating value of the head unit 234L for the head unit 234C. Each of the regulating value Δt1, Δt2 is set independently.

The black line is inclined as shown in FIG. 10A after the regulating operation but a straight line showing such a large inclination is not curved to the visual sense of the human body.

The above described operation of regulating printing timings is performed by driving the black ink-jet recording head 234 to print a test pattern on a recording medium 15. Then, values are selected and defined respectively for BL of the head unit 234L, BC of the head unit 234C and BR of the head unit 234R and set in the respective timers 234Lt, 234Ct and 234Rt.

(2) Then, printed line segments of other inks including cyan ink are registered. FIG. 11 shows line segments of different inks printed by predetermined timings. The operation of cyan ink-jet recording head 231 will be described below as example.

In this case, unlike the case of (1), the right end of the line segment printed by the left head unit 231L and the left end of the line segment printed by the center head unit 231C and the right end of the line segment printed by the center head unit 231C and the left end of the line segment printed by the right head unit 231R are not regulated so as to be junctioned properly. Rather, they are regulated relative to the line segments printed by the black head units 234L, 234C and 234R in the same printing range.

This is because each of cyan, magenta and yellow inks is seldom used solely for printing. Rather, they are often used to produce a mixed color so that, unlike black ink, steps formed at junctions are not particularly noticeable if they are those of rule marks.

Figure 13:
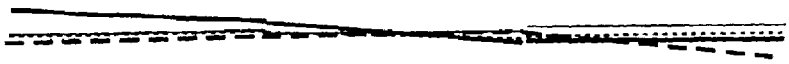
FIG. 13 shows the lines printed by the ink-jet recording heads for ink colors of the embodiment and registered at a selected position so as to minimize misregistration.

Additionally, when line segments printed by inks of these colors are regulated so as to produce proper junctions as in the case of black ink, the lines of the different colors show different inclinations as illustrated in FIG. 12. Thus, if the lines printed in different colors are registered at a selected position (the middle point of the black line in the case of this embodiment), printed lines are misregistered as a whole as shown in FIG. 13. Then, the color of the printed pattern of lines can vary depending on the position of the lines although the same inks are used at a uniform rate for printing.

Therefore, according to the invention, the timings of printing operations of the head units of inks other than black are so regulated that the middle points of the line segments printed by the head units 231L through 233L, the head units 231C through 233C and the head units 231R through 233R are located respectively at the middle points of the line segments printed by the black head units 234L, 234C and 234R.

Figure 14:
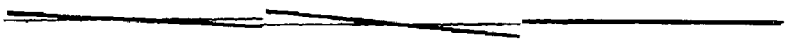
FIG. 14 shows the black and cyan lines printed by the corresponding ink-jet recording heads of the embodiment by regulating the printing timings thereof.

Now, the operation of regulating the timing of printing operation of the black ink-jet recording 234 and that of the cyan ink-jet recording head 231 will be described with reference to FIG. 14.

Firstly, the timing of printing operation of the cyan center head unit 231C is so regulated that the middle point of the line segment printed by the center head unit 234C of the black ink-jet recording head 234 agrees with the middle point of the line segment printed by the center head unit 231C of the cyan ink-jet recording head 231 as viewed in the printing direction.

Similarly, the timing of printing operation of the cyan right head unit 231R is so regulated that the middle point of the line segment printed by the black right head unit 234R agrees with the middle point of the line segment printed by the cyan right head unit 231R as viewed in the printing direction.

Finally, the timing of printing operation of the cyan left head unit 231L is so regulated that the middle point of the line segment printed by the black left head unit 234L agrees with the middle point of the line segment printed by the cyan left head unit 231L as viewed in the printing direction.

Figure 18:
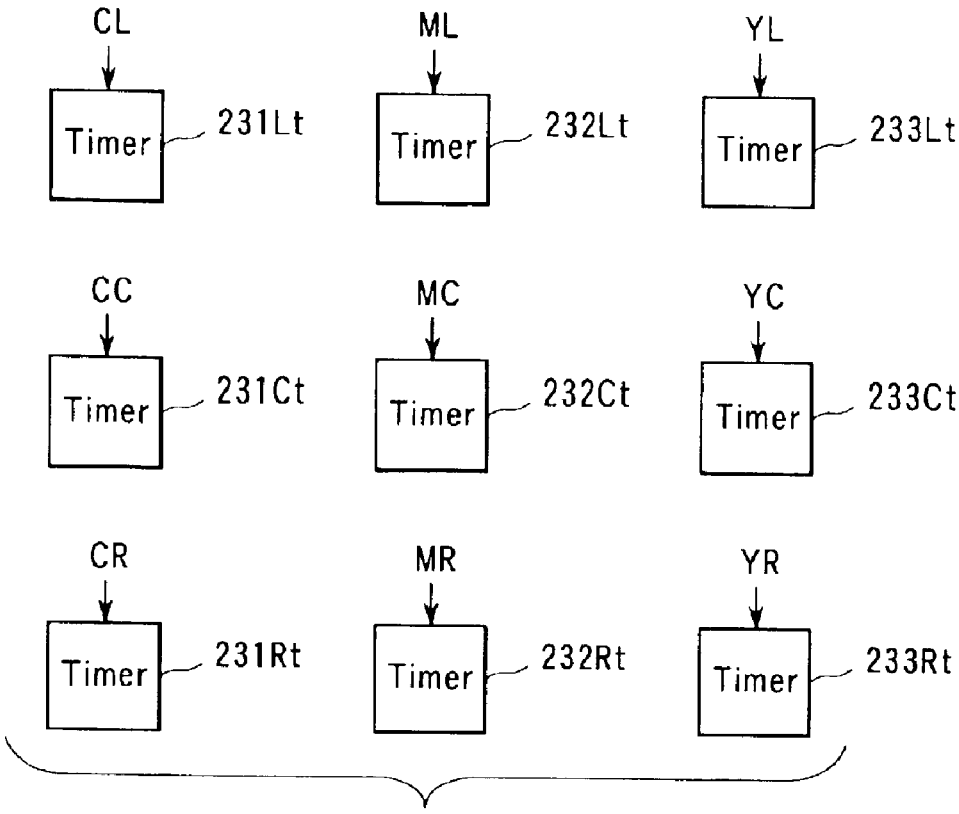
FIG. 18 is a schematic illustration showing the printing timing regulating section of the embodiment.

The above regulating operations are performed by comparing a test pattern printed by the black ink-jet recording head 234 and a comparable test pattern printed by the cyan ink-jet recording head 231. Then, as shown in FIG. 18, values are selected and defined respectively for CL, CC and CR and set in the respective timers 231Lt, 231Ct and 231Rt of the cyan ink-jet recording head 231.

It will be noted that steps formed at the junctions of the line segments printed by the head units 231R, 231C and 231L of the cyan ink-jet recording head 231 exist if they are viewed by themselves.

The printing positions of the cyan head units and those of the black head units are regulated in the above described manner. The printing positions of the magenta head units and those of the corresponding black head units are regulated and subsequently, the printing positions of the yellow head units and those of the corresponding black head units are regulated in a similar manner. Then, values are selected and defined respectively for ML, . . . , YR and set in the respective timers 232Lt through 233Rt of the magenta ink-jet recording head 232 and the yellow ink-jet recording head 233.

Figure 15:
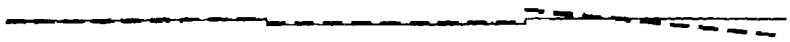
FIG. 15 shows the black and magenta lines printed by the corresponding ink-jet recording heads of the embodiment by regulating the printing timings thereof.
Figure 16:
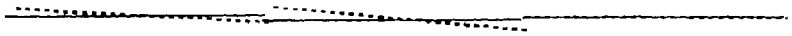
FIG. 16 shows the black and yellow lines printed by the corresponding ink-jet recording heads of the embodiment by regulating the printing timings thereof.

FIG. 15 (black and magenta) and FIG. 16 (black and yellow) show the obtained printing positions. Although they are supposed to be illustrated together, they are shown separately with reference to black for easy understanding.

Figure 17:
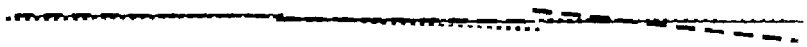
FIG. 17 shows all the lines printed by the ink-jet recording heads of the embodiment for different color inks by regulating the printing timings thereof.

FIG. 17 shows all the lines printed according to the invention. By comparing FIG. 17 and FIG. 13, it will be understood that the misregistration of FIG. 17 is much less than that of FIG. 13 in terms of colors.

While the center head unit is located on the upper stream side of the conveyance of the recording medium 15, steps formed at the junction can also be made less noticeable by arranging the center head unit on the lower stream side of the conveyance of the recording medium 15 or arranging even-numbered head units.

Figure 20:
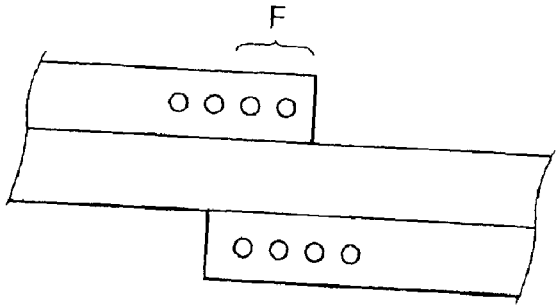
FIG. 20 is a schematic illustration showing the positional arrangement of the head units where adjacently located head units are arranged so as to overlap each other at the opposite ends.

While the head units of different color inks of the above embodiment are adapted to print at the same position, an effect similar to that of the above embodiment can be obtained by arranging two adjacently located head units of the same color so as to overlap each other at the opposite ends as indicated by F in FIG. 20 and the overlapping parts of the head units share the printing operation for a given range in order to make the step formed at the junction less noticeable.

While each ink-jet recording head 23 has three head units and four ink-jet recording heads 23 are provided to correspond to four color inks in the above described embodiment, the present invention is by no means limited thereto so long as each ink-jet recording head 23 has a plurality of head units and a plurality of ink-jet recording heads 23 are provided to correspond to so many color inks.

The present invention is also applicable to a monochromatic ink-jet recording apparatus having only an ink-jet recording head 234 for black ink.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet recording apparatus comprising:

ink-jet heads provided for respective colors including a specific color, each being formed by arranging a plurality of head units in a transversal direction perpendicular to a printing direction; and a printing timing regulating section which regulates printing timings of the respective head units so as to make the printing position of a nozzle located at an end of each of the head units of the ink-jet head of the specific color and the printing position of a nozzle located at the opposite end of an adjacent head unit coincide in the printing direction, wherein the printing timing regulating section is configured to regulate the printing timings of the ink-jet heads of the colors other than the specific color in such a way that the segments printed by the respective head units of the ink-jet heads of the colors other than the specific color and having the same size as the segments printed by the head units of the ink-jet head of the specific color are registered at the respective centers thereof without realignment of any of the ink-jet heads.

2. The apparatus according to claim 1, wherein the printing timing regulating section has timer means provided for the respective head units that start a counting operation when a printing start signal is input and output a printing timing signal when the count gets to a predetermined value and the printing timing of each of the head units is regulated by varying the predetermined value selected for corresponding timer means.

3. The apparatus according to claim 1, wherein the specific color is black.

4. The apparatus according to claim 1, wherein the specific color is the most conspicuous color.

5. The apparatus according to claim 1, wherein the specific color is the color that is used most frequently.

6. The apparatus according to claim 1, wherein the printing timing regulation section has timer means provided for the respective head units that start a counting operation when a printing start signal is input and output a printing timing signal when the count gets to a predetermined value and the printing timing of each of the head units is regulated by varying the predetermined value selected for the corresponding timer means.

7. The apparatus according to claim 1, wherein the specific color is black.

8. The apparatus according to claim 1, wherein the specific color is the most conspicuous color.

9. The apparatus according to claim 1, wherein the specific color is the color that is used most frequently.

10. The apparatus according to claim 1, wherein an end of each of the head units of the ink-jet heads is arranged in such a way that it does not overlap the nozzle located at an end of the adjacent head unit.

11. The apparatus according to claim 1, wherein an end of each of the head units of the ink-jet heads is arranged in such a way that it partly overlaps the nozzle located at an end of the adjacent head unit.

12. The apparatus according to claim 1, wherein each head unit of the plurality of head units includes a plurality of nozzles linearly arranged in a direction perpendicular to the printing direction.

* * * * *